US005331781A

United States Patent [19]

Gilbert

[11] Patent Number: 5,331,781

[45] Date of Patent: Jul. 26, 1994

[54] STORAGE APPARATUS

[75] Inventor: David L. Gilbert, Queensland, Australia

[73] Assignee: Ultrapark Australia Pty. Ltd., Queensland, Australia

[21] Appl. No.: 877,179

[22] PCT Filed: Jan. 18, 1991

[86] PCT No.: PCT/AU91/00021

§ 371 Date: Jul. 1, 1992

§ 102(e) Date: Jul. 1, 1992

[87] PCT Pub. No.: WO91/10794

PCT Pub. Date: Jul. 25, 1991

[30] Foreign Application Priority Data

Jan. 19, 1990 [AU] Australia ..... PJ8249

[51] Int. Cl.[5] ..... E04H 6/42; E04H 6/00

[52] U.S. Cl. ..... 52/143; 52/174; 414/253

[58] Field of Search ..... 52/185, 741.1, 122.1, 52/174, 143; 414/253, 259, 240, 231, 252

[56] References Cited

U.S. PATENT DOCUMENTS

| | | | |
|---|---|---|---|
| 687,491 | 11/1901 | Ayres | 414/253 |
| 2,876,913 | 3/1959 | Roth et al. | 414/253 |
| 3,583,584 | 6/1971 | Iacco | 414/279 |
| 3,608,748 | 9/1971 | Wilson | 214/16.1 |
| 3,710,957 | 1/1973 | Small | 414/252 X |
| 3,774,784 | 11/1973 | Glass | 214/16.1 |
| 4,124,123 | 11/1978 | Armington et al. | 52/174 X |
| 4,150,758 | 4/1979 | Mascherpa | 414/282 |
| 4,307,985 | 2/1981 | Desprez et al. | 410/46 |
| 4,793,760 | 12/1988 | Valli | 14/256 X |
| 4,986,714 | 1/1991 | Fernstrom | 414/240 X |
| 5,018,926 | 5/1991 | Sternad | 414/252 X |
| 5,049,022 | 9/1991 | Wilson | 414/253 |
| 5,069,592 | 12/1991 | Galperin | 414/240 |

FOREIGN PATENT DOCUMENTS

| | | | |
|---|---|---|---|
| 232364 | 12/1958 | Australia . | |
| 68192/87 | 2/1987 | Australia . | |
| 20454/88 | 8/1987 | Australia . | |
| 4723789 | 12/1989 | Australia . | |
| 0340673 | 4/1989 | European Pat. Off. . | |
| 2131157 | 12/1971 | Fed. Rep. of Germany | 414/231 |
| 2926263 | 6/1979 | Fed. Rep. of Germany . | |
| 3800118 | 1/1988 | Fed. Rep. of Germany . | |
| 1278789 | 11/1960 | France . | |
| 1396499 | 3/1964 | France . | |
| 1421840 | 1/1965 | France . | |
| 1451651 | 10/1965 | France . | |
| 2094581 | 6/1970 | France . | |
| 8912152 | 12/1989 | PCT Int'l Appl. . | |
| 9117937 | 11/1991 | PCT Int'l Appl. . | |
| 2183619 | 6/1987 | United Kingdom | 414/253 |
| 8603246 | 6/1986 | World Int. Prop. O. | 414/231 |

OTHER PUBLICATIONS

Abstract 62-259908 Japan Nov. 1987 Ueda.

Abstract 1-187110 Japan Jul. 1989 Miyamoto.

*Primary Examiner*—Rodney M. Lindsey

*Attorney, Agent, or Firm*—Biebel & French

[57] ABSTRACT

An automated car park (10) is illustrated having a plurality of storage locations (21) arranged on a plurality of levels (42) and transportation means (53) for transporting the cars to or from selected storage locations (21). The transportation means (53) includes a pallet truck (57) which travels along guide rails (32) positioned on either side of an aisle (44) separating opposing rows of storage locations. A pallet dolly (56) supports a pallet (55) upon which a car (54) may be supported and enables a selected pallet to be transferred between storage locations (21) and the pallet truck (57). Lifting means are provided to lift the pallet truck between levels.

10 Claims, 13 Drawing Sheets

Figure 9 (Detail)

STORAGE APPARATUS

BACKGROUND OF THE INVENTION

This invention relates to storage apparatus.

This invention has particular but not exclusive application to automated car parks, and for illustrative purposes reference will be made to such application. However, it is to be understood that this invention could be used in other applications, such as for the storage of large objects such as boats or containers or small objects such as component parts stored in a predetermined location to facilitate automatic retrieval of selected stored parts.

Conventional multi-story car parks or garages are predominately permanent structures of concrete construction. Such car parks are extremely inefficient in terms of the cost of building materials and space required to store cars. The most efficient car parks require approximately 26 square meters of floor for every car space provided. This figure includes the actual car space of approximately 14 square meters plus a percentage for the ramps, aisles and walkways needed to accommodate the movement of both vehicles and pedestrians.

In addition, such car parks often require the installation of lifts and fire escapes which occupy space which may otherwise be used to store additional vehicles and require lighting, signage and mechanical ventilation which contribute to the overall installation and running costs of the car park. Furthermore, whilst driving within such car parks there always exists the possibility of accidents occurring which may involve other vehicles or pedestrians.

SUMMARY OF THE INVENTION

The present invention aims to alleviate the above disadvantages and to provide storage apparatus which will be reliable and efficient in use. Other objects and advantages of this invention will hereinafter become apparent.

With the foregoing and other objects in view, this invention in one aspect resides broadly in storage apparatus including:

- a plurality of storage locations at which articles may be stored;
- transportation means for transporting the articles to or from selected locations, and
- control means for controlling the transportation means.

Preferably the control means is automated and the storage locations are arranged in respective vertically spaced levels which may be constituted by respective locations in a demountable structure or a fixed structure as desired. In such an arrangement it is preferred that each level be provided with guide means for guiding a carriage assembly from any selected storage location to lifting means for lifting the carriage assembly or the article thereon from any selected level to or from a datum level or to any selected level from which articles may be discharged. Of course any desired number of lifting means may be provided to service all or selected ones of the levels.

If desired a respective carriage assembly or a plurality of carriage assemblies may be provided on a particular level and transfer means may be provided to transfer the articles from the carriage assemblies to selected storage locations. Alternatively the guide means may be a rail assembly having branch rails associated with each storage location whereby the carriage assembly may travel to or from the lifting means into selected storage locations. Separate transfer means may be provided at each storage location but preferably the transfer means is associated with the carriage assembly.

The articles may be stored on a separate carriage assembly at each storage location but preferably the articles are stored on pallets which together with the article may be transferred to a carriage assembly by the transfer means. The latter may include article lifting means for this purpose.

Suitably the storage locations in the various levels are arranged in vertical and horizontal rows but of course such alignment is not essential and for example the storage locations may be of different sizes and arranged in an irregular manner. In one embodiment, the storage locations form part of a building comprising at least one floor and wherein each storage location is defined by a particular location on a respective floor. Each storage location may be further defined by one or more side walls and/or an entrance which may include closure means such as a door or gate. In an alternative embodiment, the storage locations may include a plurality of adjacent box like structures preferably releasably secured to one another. Each box like structure may include a box like frame which may be fully or partially clad and wherein each box like structure may constitute a single storage location or a plurality of storage locations. In yet another embodiment, the storage locations may include a plurality of frame members, preferably releasably secured to one another, which when assembled combine to create a rack like structure comprising at least one level on which there exists a plurality of storage locations. Each storage location or a select number of storage locations may include surrounding walls including a door or gate.

The floor and/or the ceiling of each storage location may be partially clad and in one embodiment the cladding may cover only that portion of the floor and/or the ceiling which may lie beneath selected portions of a motor vehicle such as the front and rear axles, the motor or other components likely to leak oil on to vehicles stored below. In addition, the floor may include sufficient cladding for the purpose of providing maintenance personnel with a supporting platform on which they may work.

The lifting means for lifting articles to selected levels of the apparatus in one embodiment may include support means for supporting a carriage assembly including support rails along or between which the various carriage assemblies may move. Preferably the support rails cooperate with the aforementioned guide means. In yet another embodiment, the lifting means may include support means such as a support surface or opposing supporting flanges upon which a pallet may be supported.

Each carriage assembly preferably includes at least one platform or pallet for supporting an article, a portion of an article or alternatively, a plurality of articles thereon. Preferably each platform or pallet is releasably supported upon an associated carriage assembly thereby enabling the pallet and the article supported thereon to be deposited in a selected storage location.

The shape of each pallet may be configured so as to restrict or minimise the movement of articles supported thereon relative to the pallet. In one embodiment each pallet may include recesses formed therein for the location of respective wheels of a vehicle. Alternatively or in addition to the inclusion of recesses of the type described, each pallet may be equipped with locking means adapted to engage an article supported on the pallet.

To facilitate rotation of an article such as a vehicle which may be mounted on a pallet or a plurality of pallets so that the vehicle is facing the opposite direction to that which it may have entered the storage apparatus, each carriage assembly may be equipped with a turn table upon which the pallet or pallets are supported.

Each carriage assembly may be driven by an electric, hydraulic or pneumatic motor and wherein the alternating or direct current, fluid or compressed air is delivered to the motor by a power source located on the carriage or by transmission means which may include or incorporate the guide means.

Movement of the transportation means within the confines of the array of storage locations, including movement of the pallets within a storage location, is preferably controlled by a central computer and wherein instructions may be transmitted to individual carriages from the computer via infrared, radio, microwave or visible light remote control signals which may in turn be stored and processed by a computer mounted on each carriage assembly. Accordingly, in one embodiment radio signals may be transmitted via leaky coaxial cables positioned throughout the storage apparatus and gathered by receivers mounted on each of the carriage assemblies. In an alternative embodiment instructions may be transmitted to a series of control switches mounted on each of the carriage assemblies by radio transmission or electrical impulses.

In order to determine the position of respective carriage assemblies within the apparatus, there preferably are provided sensors positioned throughout the apparatus and/or on each of the carriage assemblies. The sensors preferably communicate with the control means.

The storage apparatus may also include pallet storage and delivery facilities and/or apparatus for the storage of large numbers of pallets and the subsequent positioning of pallets on carriages which temporarily do not include a pallet or which are deficient in the total number of pallets they may carry. In one embodiment, the pallet storage facilities may include a rack like structure in which individual pallets are stored one above another and wherein, for the purpose of collecting pallets, the structure permits the passage of a carriage between pallets stored on adjacent levels. In an alternative embodiment the pallets may be positioned one on top of the other and stored within a shaft. The uppermost pallet may be maintained in a position adjacent the top of the shaft by an upwardly directed hydraulic or pneumatic force whilst awaiting collection by a passing carriage. In yet another embodiment, pallets may be deposited upon carriages as they pass beneath a collection of pallets stacked one on top of the other within a storage shaft.

In order that this invention may be more easily understood and put into practical effect, reference will now be made to the accompanying drawings which illustrate a preferred embodiment of the invention, wherein:

BRIEF DESCRIPTION OF ACCOMPANYING DRAWINGS

FIG. 9 is a sectional view of a pallet dolly constructed in accordance with the present invention;

DESCRIPTION OF PREFERRED EMBODIMENTS

Figure 1A:
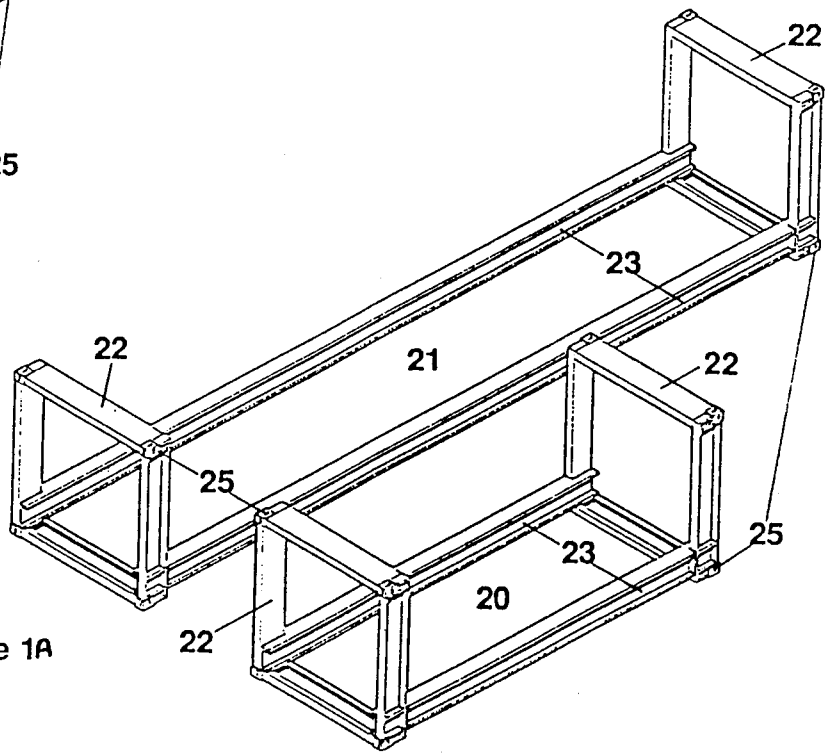
FIG. 1 is an isometric view of a plurality of box like structures constructed in accordance with the present invention.
Figure 1:
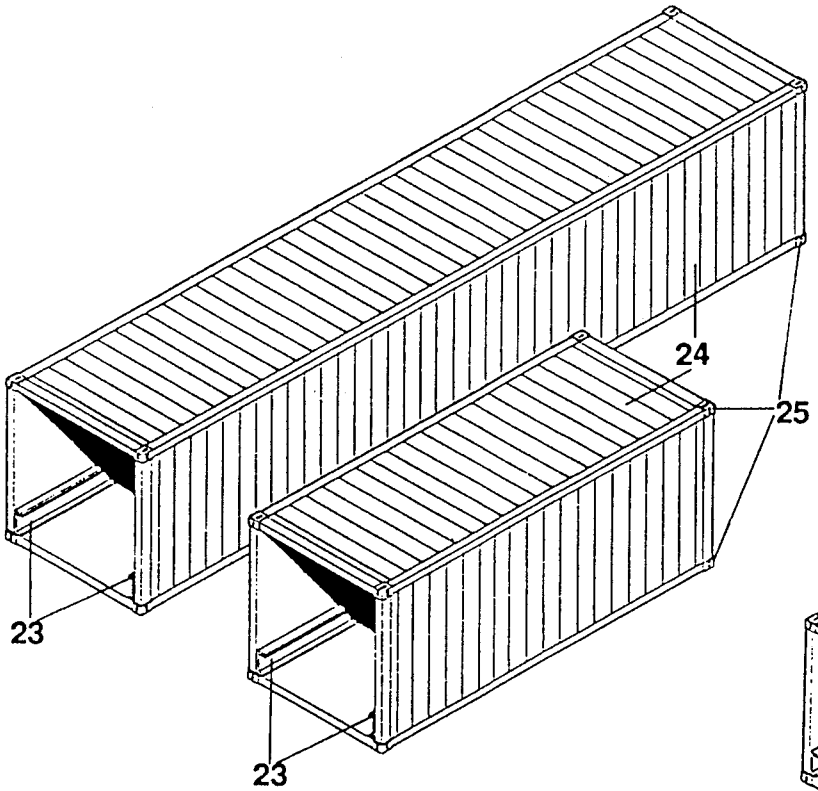

FIG. 1 illustrates a two alternative storage locations or storage bays 20 and 21 for the storage therein of a single vehicle or two vehicles respectively. Each bay includes a substantially box like framework including opposed, rectangularly shaped end bay frame members 22 and intermediate longitudinal bay frame members 23. The storage bays 20 and 21 may also include a plurality of wall panels affixed to the frame members so as to enclose the storage bays. The corners of each end bay frame member 22 each include a mounting box 25, the three external faces 26 of which include a respective mounting aperture 27 formed therein.

FIG. 1 also illustrates two shipping containers 24 constructed in accordance with international standards governing the construction of shipping containers which may be stacked both side by side and atop one another so as to create an array of storage locations. Each container includes corner mounting boxes of the type indicated by reference numeral 25 and have had fitted thereto additional longitudinal frame members 23 along which transportation means may travel.

Figure 2:
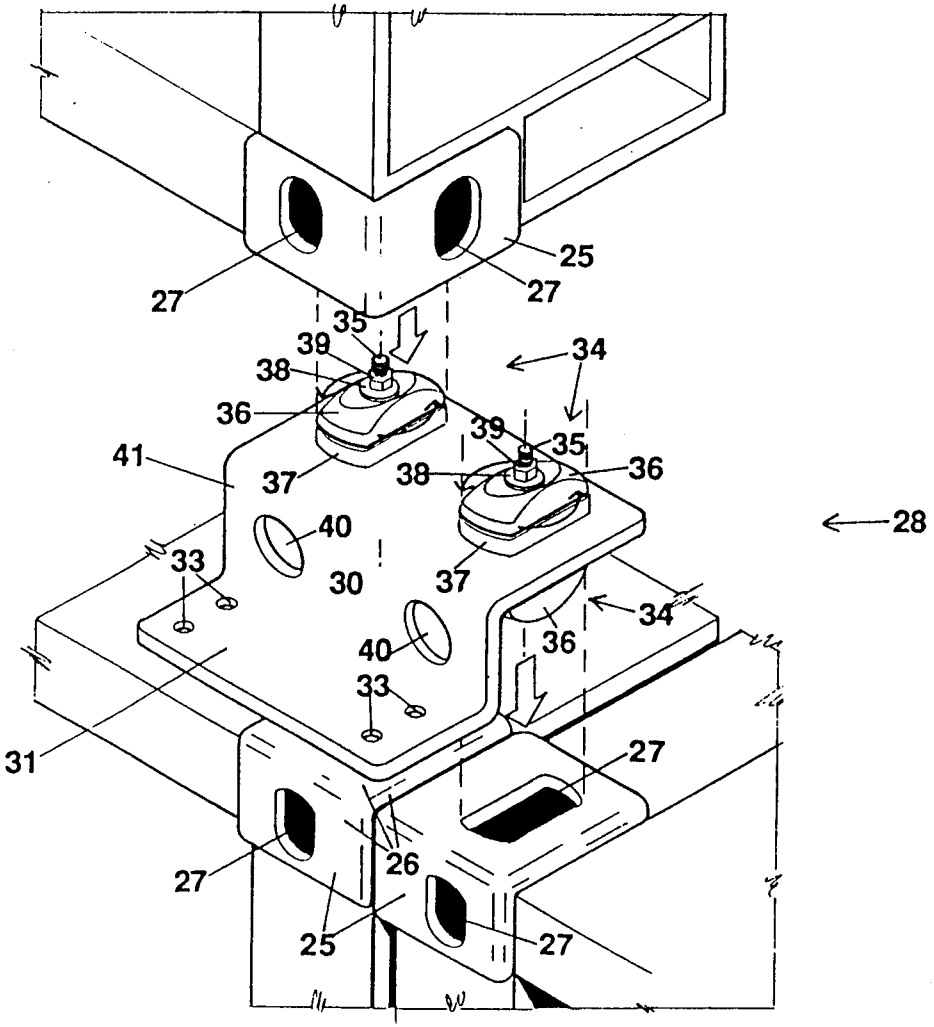
FIG. 2 is an isometric view of joining means for the releasable attachment of adjacent box like structures of the type illustrated in FIG. 1.
Figure 3:
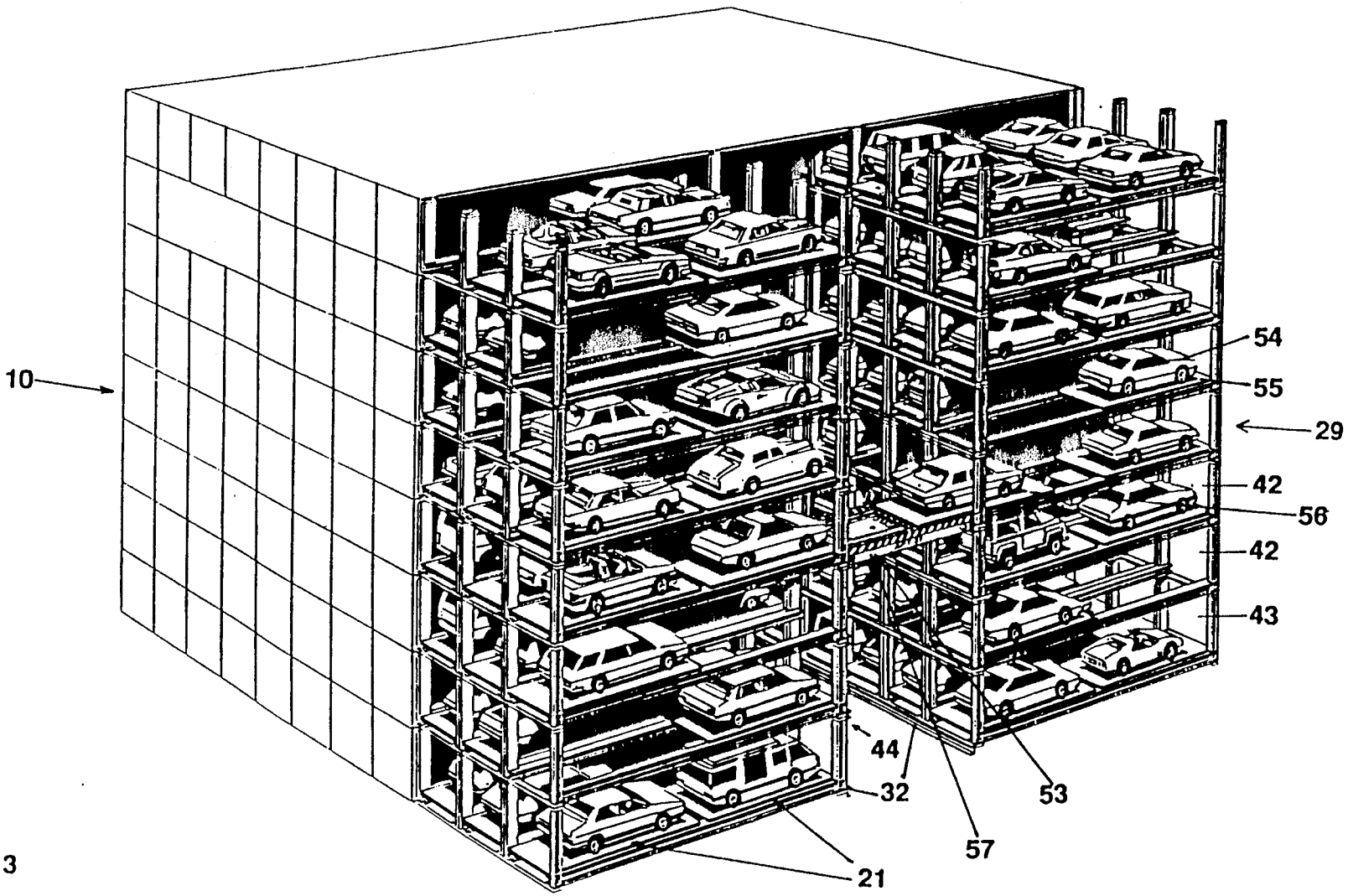
FIG. 3 is a perspective view of an array of storage locations constructed in accordance with the present invention.

Joining means 28 such as that illustrated in FIG. 2 may be used to secure adjacent storage bays 20 or 21 or shipping containers 24 together so as to create an array of storage bays 29 as illustrated in FIG. 3. The joining means 28 includes a "Z" shaped mounting bracket 30 including flange 31 to which may be attached tracks 32 or sheets of prefabricated cladding utilizing apertures 33 formed therein. There is also provided four mounting members 34 secured to the bracket, each mounting member including a shaft 35, the ends of which are threaded, clamps 36, spacers 37, washers 38 and nuts 39. The clamps 36 and spacers 37 are substantially elliptical in shape and are adapted to fit within the correspondingly shaped mounting apertures 27 of a mounting box 25. Adjacent mounting boxes 25 may be releasably secured together by rotating the clamps 36 contained within each box through an angle of 90 degrees and by tightening nuts 39, access to which is provided by apertures 40 formed in web portion 41 of mounting bracket 30.

Preferably the storage bays 20 and 21 are created from a supporting framework, the overall dimensions of which correspond with those of shipping containers. This would enable the storage bays to be transported in an assembled state on board road transports, railway carriages or ships utilizing conventional means for securing shipping containers thereto.

Figure 4:
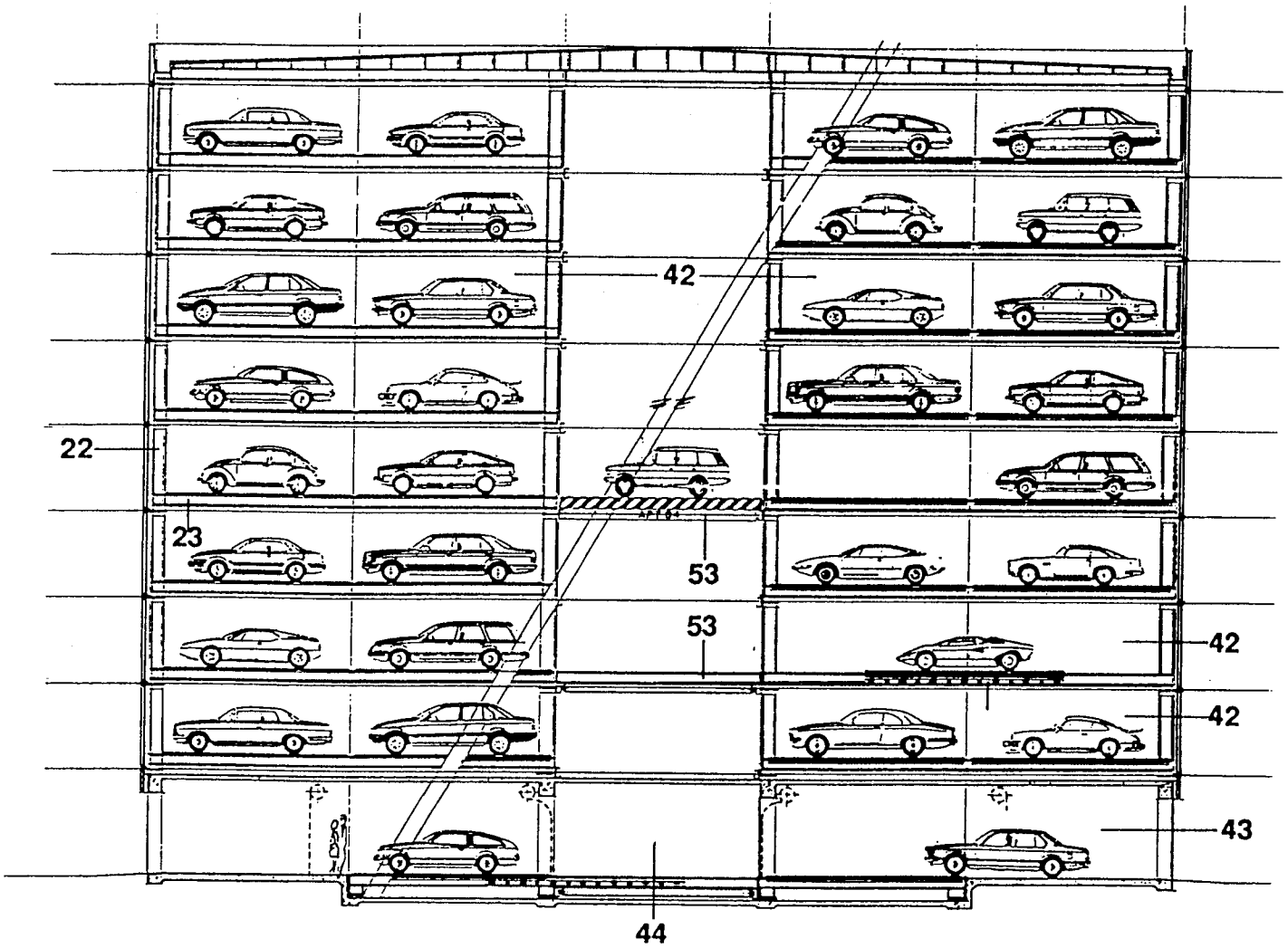
FIG. 4 is a sectional view of the array of storage locations illustrated in FIG. 3.
Figure 5:
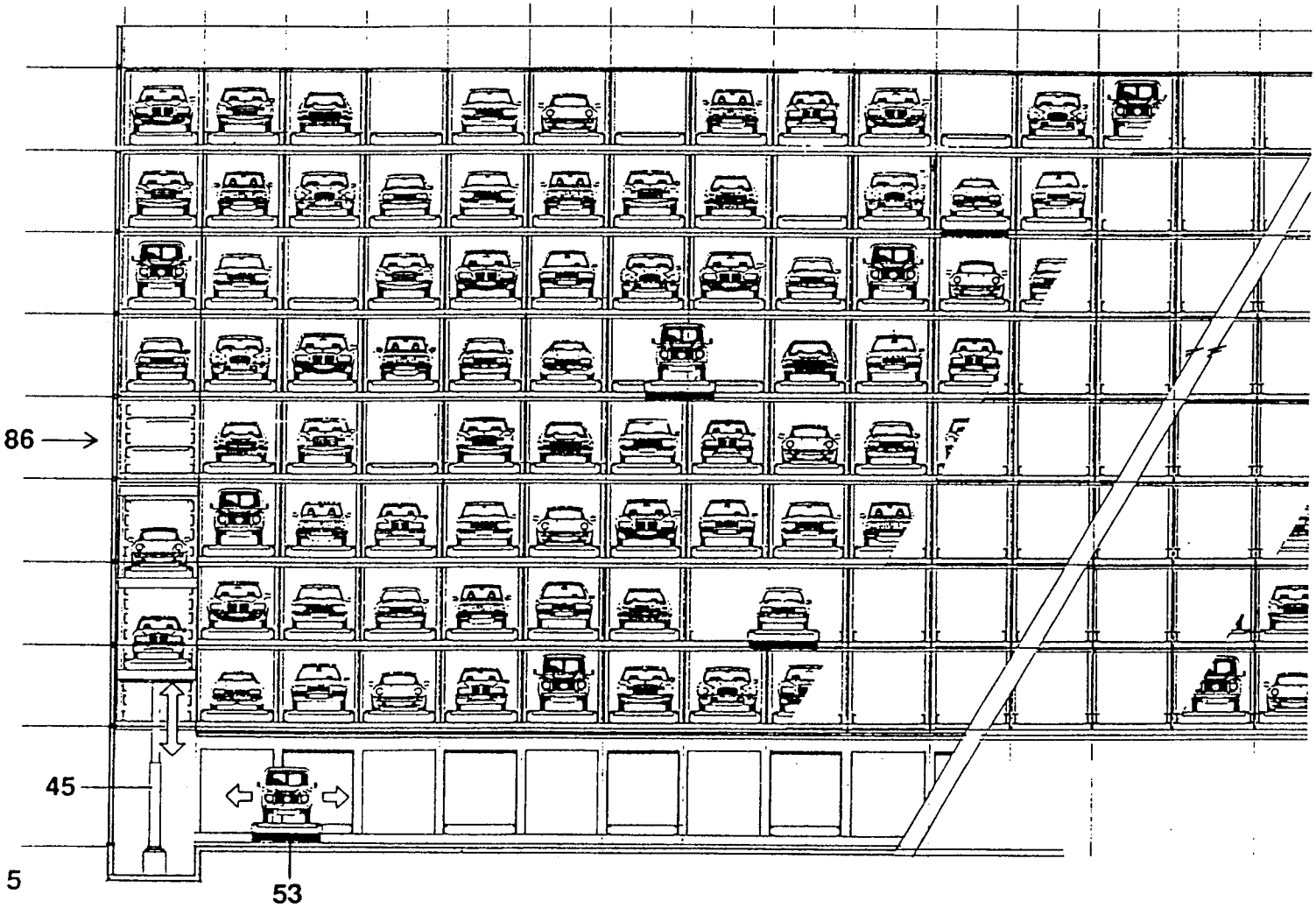
FIG. 5 is a sectional view of the array of storage locations illustrated in FIG. 3.

FIGS. 3, 4 and 5 illustrate a preferred layout or array 29 of storage bays including a plurality of storage bays 21 stacked side by side and one above the other so as to create a number of levels 42 including a ground or parking level 43. Each level, 42 or 43, includes an aisle 44 separating storage bays 21 positioned on either side thereof.

Vehicles may be promoted to an upper level by lifts or hoists 45 positioned at either or both ends of the aisles 44. It will however be appreciated that in other embodiments, the parking level may be situated either on the top level or on an intermediate level of the array and that each level 42 may include more than one aisle 44 and that the aisles on each level may be interconnected so as to form a network of path ways along which vehicles may be conveyed to and from selected storage locations. It will also be appreciated that additional lifts or hoists 45 may be positioned in locations along each aisle other than at the ends of each aisle as indicated.

Figure 6:
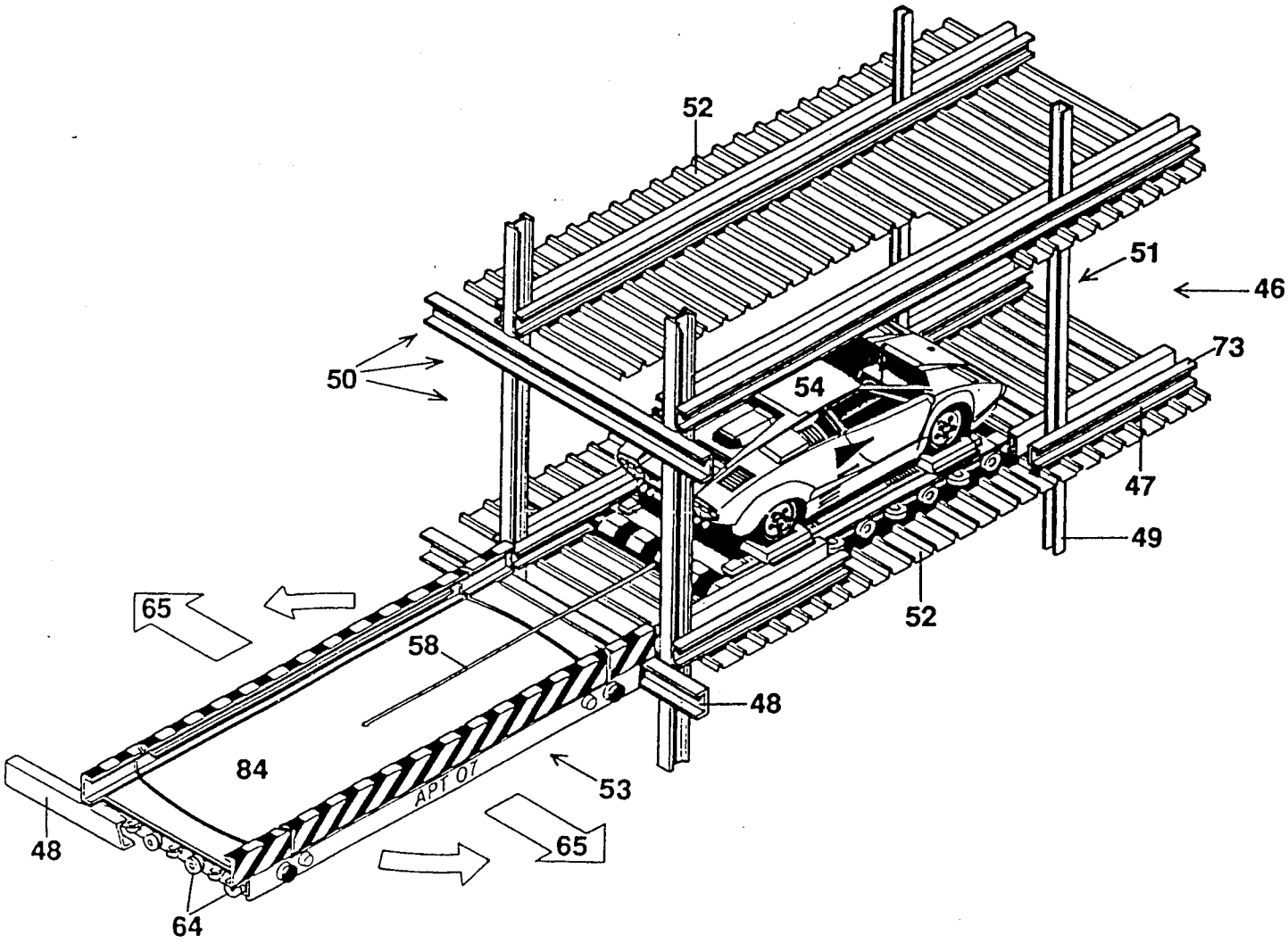
FIG. 6 is an isometric view of an alternative array of storage locations constructed in accordance with the present invention.

FIG. 6 illustrates an alternative configuration of storage locations 46 constructed from a plurality of longitudinal, transverse and upright channel shaped frame members 47, 48 and 49 respectively, permanently or releasably secured together so as to form a plurality of adjacent box like structures 50 each constituting a single storage location 51 and wherein the box like structures are arranged so as to form an array having a plurality of levels each comprising a number of rows of storage locations separated by aisles and wherein vehicles are conveyed between levels by elevators positioned at the ends of selected aisles.

Opposing pairs of longitudinal and transverse frame members 47 and 48 respectively also serve as tracks or channels along which the transportation means 53 may travel. Each storage location 51 includes a floor 52 comprising sheets of cladding material secured to the longitudinal frame members 47.

Figure 7:
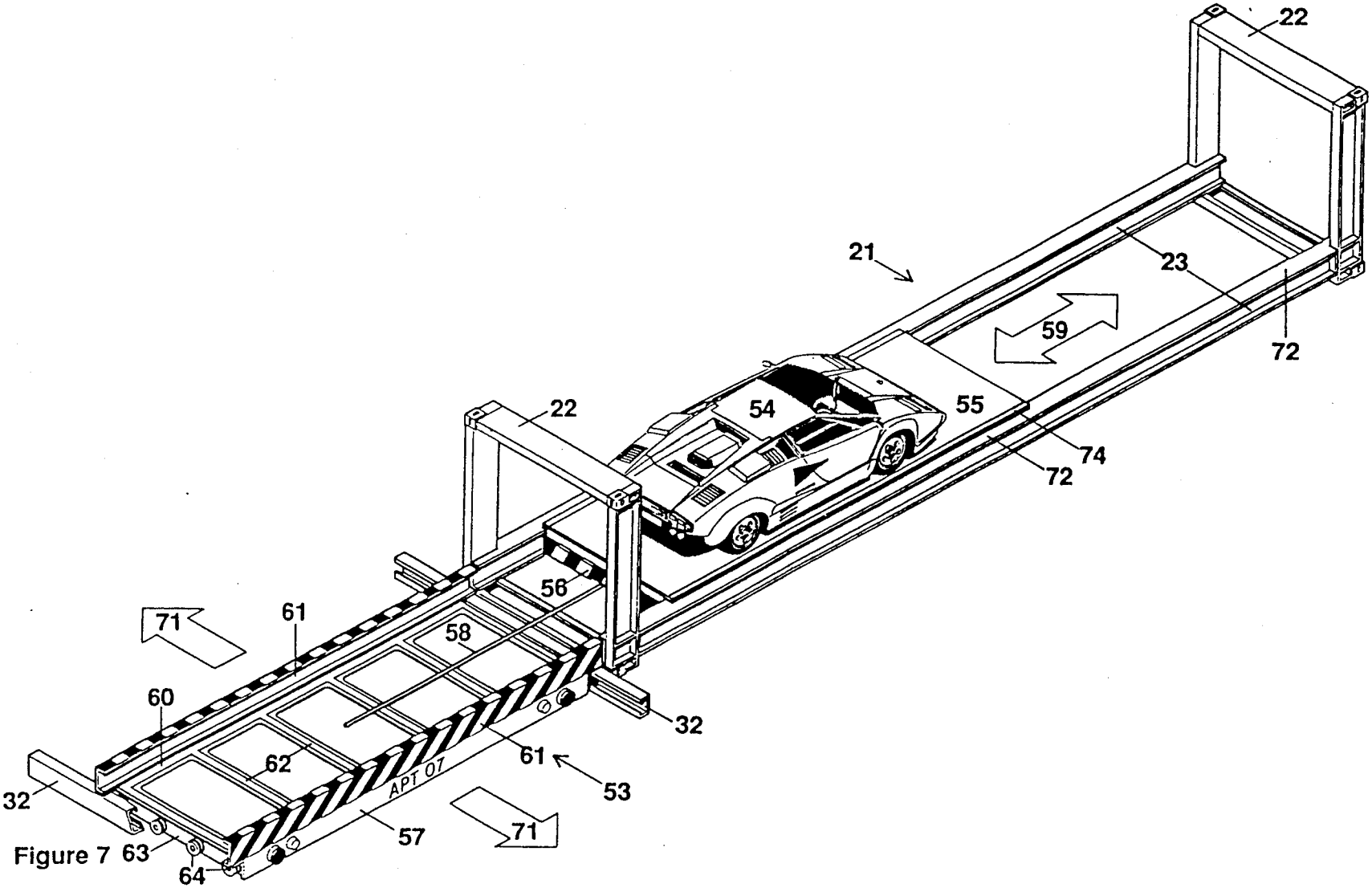
FIG. 7 is an isometric view of transportation means constructed in accordance with the present invention.
Figure 8:
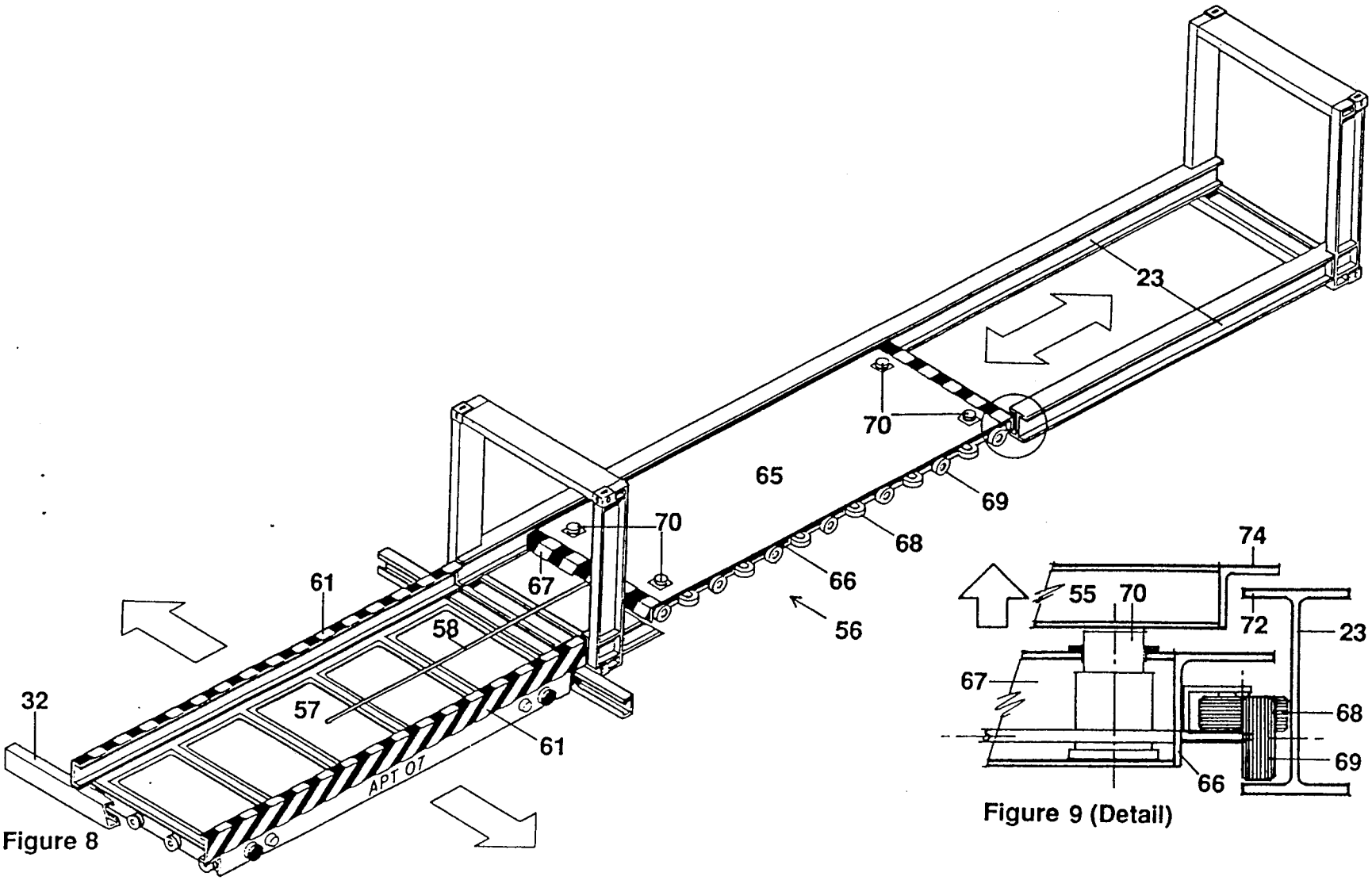
FIG. 8 is an isometric view of the transportation means illustrated in FIG. 7.

FIGS. 7, 8 and 9 illustrate transportation means 53 used to transport a vehicle 54 within the confines of an array of storage locations 50. The vehicle 54 is parked on a pallet 55 supported on a pallet dolly 56 shown tethered to a pallet truck 57 by a retractable power cable or pneumatic or hydraulic hose 58 which enables the pallet dolly 56 to track backwards and forwards relative to the pallet truck 57 in the direction of arrow "59".

Each pallet truck 57 comprises a substantially rectangularly shaped chassis 60 including a pair of opposed, channel shaped, longitudinal chassis members 61 and a plurality of intermediate transverse chassis members 62 including transverse end chassis members 63. The chassis 60 further includes a plurality of rollers 64 mounted on both transverse end chassis members 63 such that the rollers extend outwardly from the chassis 60 and locate within respective channel shaped recesses of opposing tracks 32 or opposing transverse structural frame members 48.

The rollers 64 enable the pallet truck 57 to travel along tracks 32 or frame members 48 extending along the periphery of aisles 44 in the direction of arrows "71". It will however be appreciated that in addition to the rollers 64 mounted on the transverse end chassis members 63, additional rollers may have been mounted on each of the longitudinal chassis members 61 thereby enabling the pallet truck 57 to travel along additional tracks 32, not shown, or opposing longitudinal structural frame members 47 which meet transversely with the tracks 32 illustrated in FIG. 7 or the transverse frame members 48 respectively. It will also be appreciated that a combination of horizontally and vertically orientated rollers 64, as illustrated in FIG. 6, may have been employed and that "L" shaped channel members may have been used in place of the tracks 32 and the structural frame members 47 and 48 illustrated in the appended figures.

The pallet dolly 56 also comprises a substantially rectangularly shaped chassis 65 including opposed longitudinal chassis members 66 and intermediate transverse end chassis members 67. The pallet dolly 56 also includes a plurality of rollers 68 and 69 mounted in alternating horizontal and vertical attitudes respectively along each of the longitudinal chassis members 66 such that the rollers extend outwardly from the chassis 65 as illustrated in FIG. 8. The rollers 68 and 69 are adapted to travel within the channel shaped recesses of opposing longitudinal chassis members 61 of a pallet truck 57, the longitudinal bay frame members 23 of a storage bay 20 or 21, or opposing longitudinal structural frame members 47. The pallet dolly 56 also includes four hydraulicly, pneumaticly or electrically operated jacks 70 which support the pallet 55.

The pallet 55, see FIG. 7, includes a substantially rectangular shaped panel adapted to fit between the upper flanges 72 of the longitudinal bay frame members 23 or the upper flanges 73 of opposing longitudinal structural frame members 47. The pallet 55 also includes two outwardly directed flanges 74 extending along the longitudinal edges of the panel 55 and wherein the flanges 74 overlie the flanges 72 of opposing longitudinal bay frame members 23 or the flanges 73 of opposing longitudinal structural frame members 47. However, it will be appreciated that a plurality of outwardly directed flanges extending along the longitudinal edges of the panel may be substituted for each flange 74.

Figure 10:
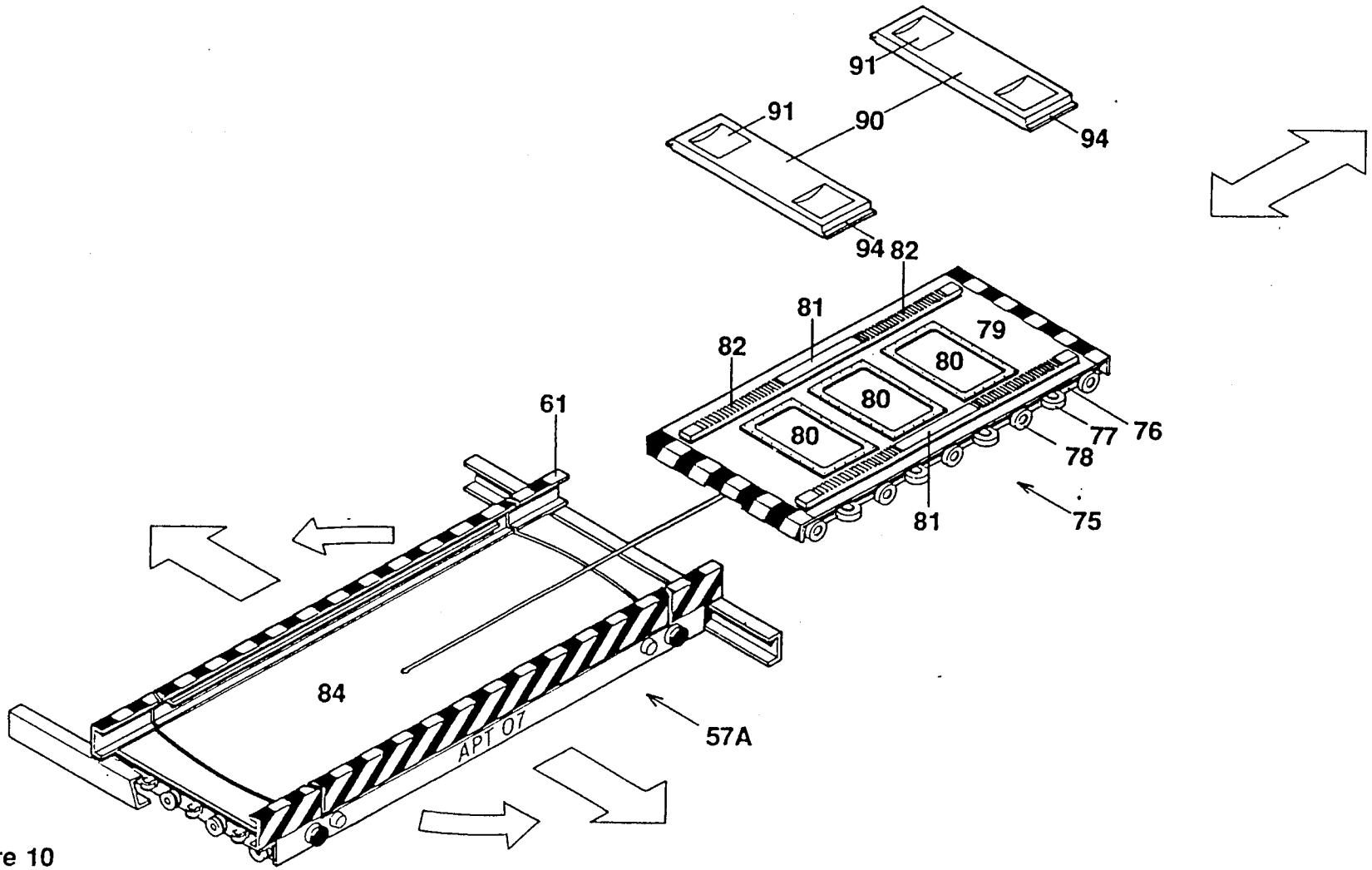
FIG. 10 is an isometric view of alternative transportation means constructed in accordance with the present invention.

FIGS. 6 and 10 illustrate a pallet dolly 75 similar in construction to the pallet dolly 56 described above and wherein the pallet dolly 75 includes a chassis 76 and a plurality of rollers 77 and 78 mounted in alternating horizontal and vertical attitudes respectively along the longitudinal side walls of the chassis 76. The rollers 77 and 78 are adapted to travel within the channel shaped recesses of opposing longitudinal chassis members 61 of a pallet truck 57, the longitudinal bay frame members 23 of a storage bay 20 or 21, or opposing longitudinal structural frame members 47. The pallet dolly 75 also includes a deck 79 secured to the chassis and a plurality of access panels 80 covering access openings formed in the deck 79. The access panels 80 also serve as drip trays for the collection of oil and condensate deposited thereon as a result of the storage of vehicles 54 on the pallet dolly 75.

Figure 11:
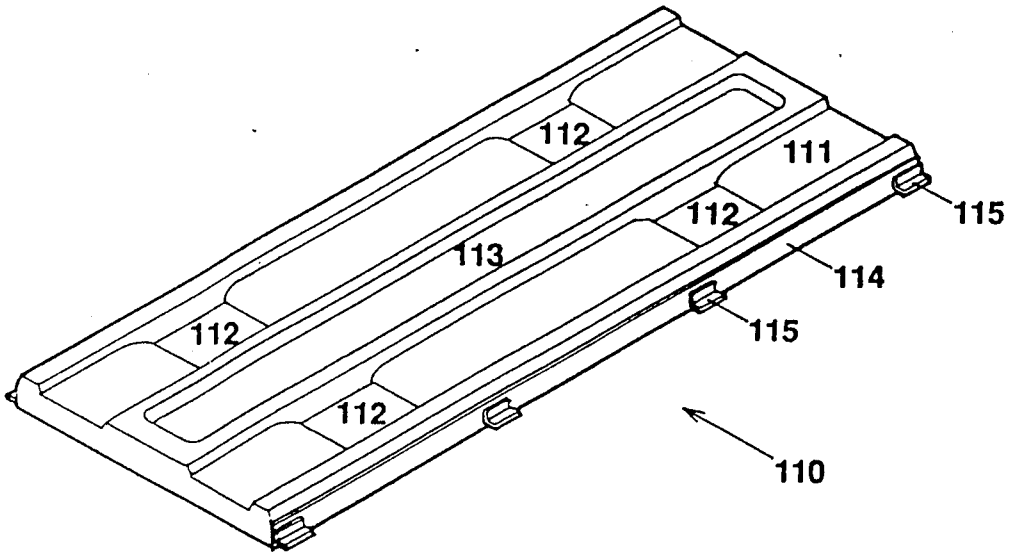
FIG. 11 is an isometric view of a typical pallet constructed in accordance with the present invention.
Figure 12:
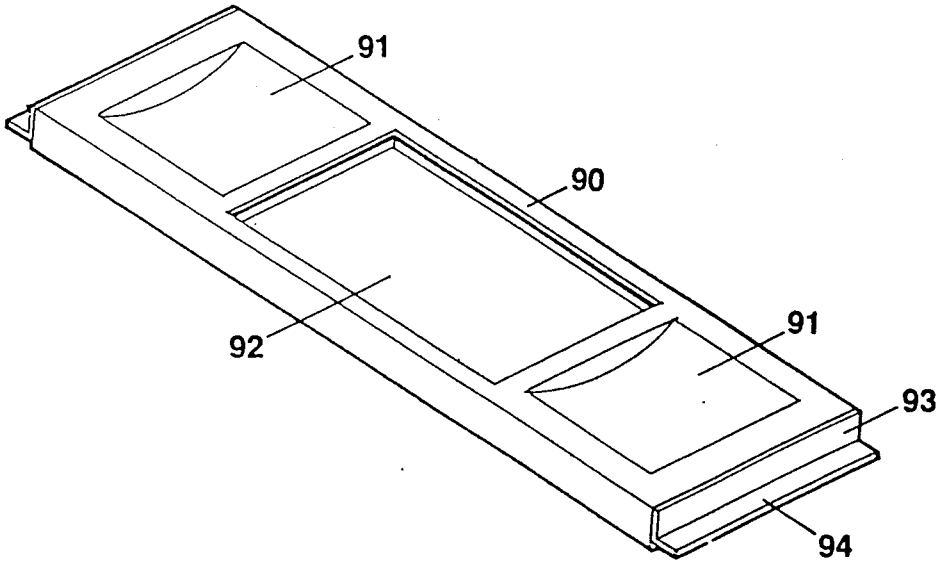
FIG. 12 is an isometric view of an alternative pallet to that illustrated in FIG. 11.

The pallet dolly 75 is also provided with two parallel support rails 81 upon which may be supported pallets of the type illustrated in FIGS. 7 and 11 for supporting both the front and rear wheels of a vehicle or a pair of smaller pallets 90 illustrated in FIGS. 10 and 12 for supporting either the front or rear wheels of a vehicle. To facilitate location of the pallets on the support rails 81 and to minimise movement of the pallets relative to the support rails 81, the upper or exposed surfaces of the support rails include a series of grooves 82 formed therein which may mesh with a series of notches formed in the underside of the pallet or pallets to be supported thereon. Beneath each support rail 81 there is provided one or more jacks for lifting the rails and the pallets supported by on the rails.

The smaller pallets 90 are provided with a pair of wheel locating recesses 91 in which the wheels of a vehicle may be positioned and a drip tray 92 for the collection of spilt oil and vehicle condensate. The longitudinal sides 93 of the pallets 90 each include an outwardly directed flange 94 which is adapted to overlie and abut the flanges 72 of opposing longitudinal bay frame members 23 or the flanges 73 of opposing longitudinal structural frame members 47.

Figure 13:
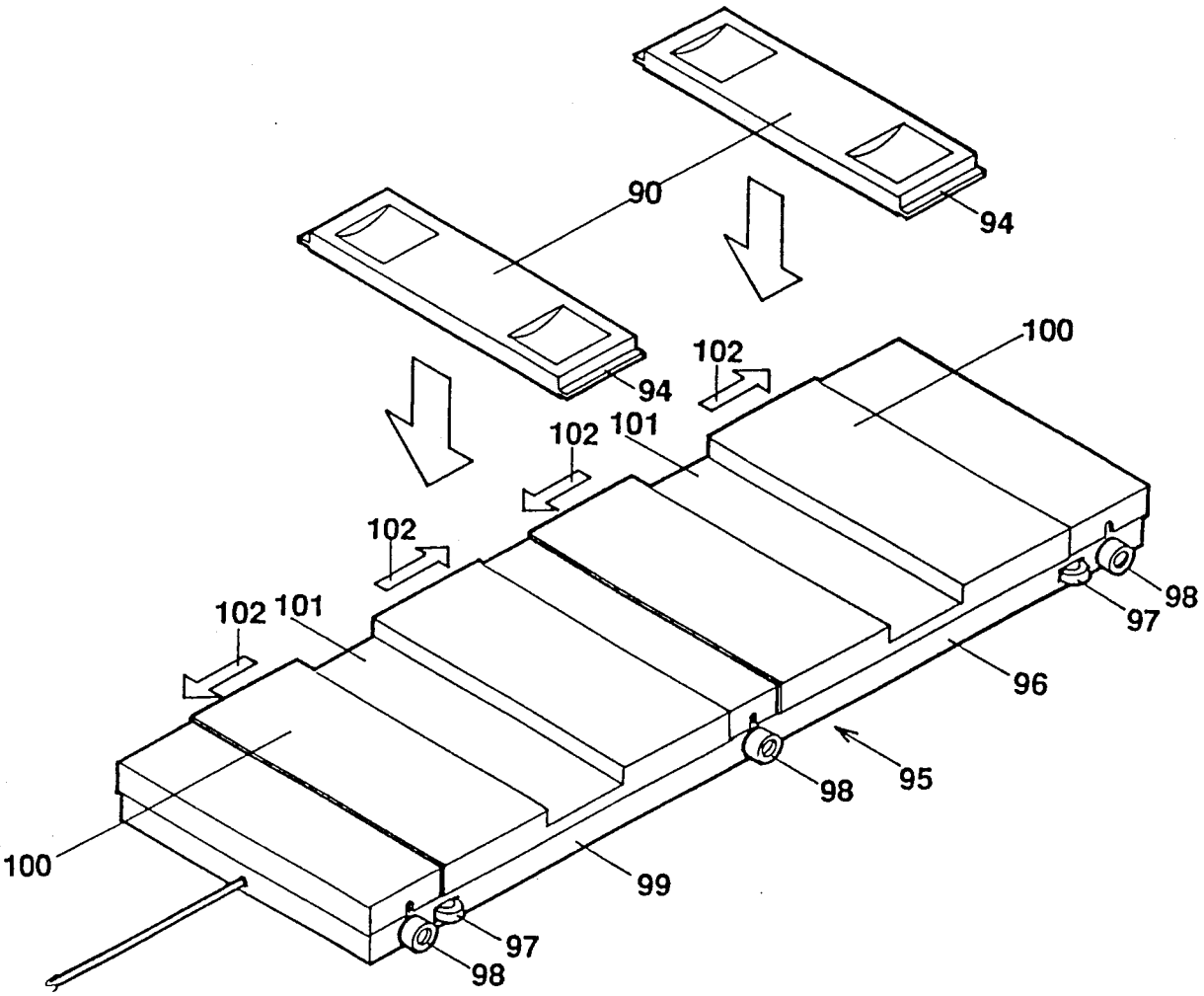
FIG. 13 is an isometric view of a pallet locating module constructed in accordance with the present invention.
Figure 14:
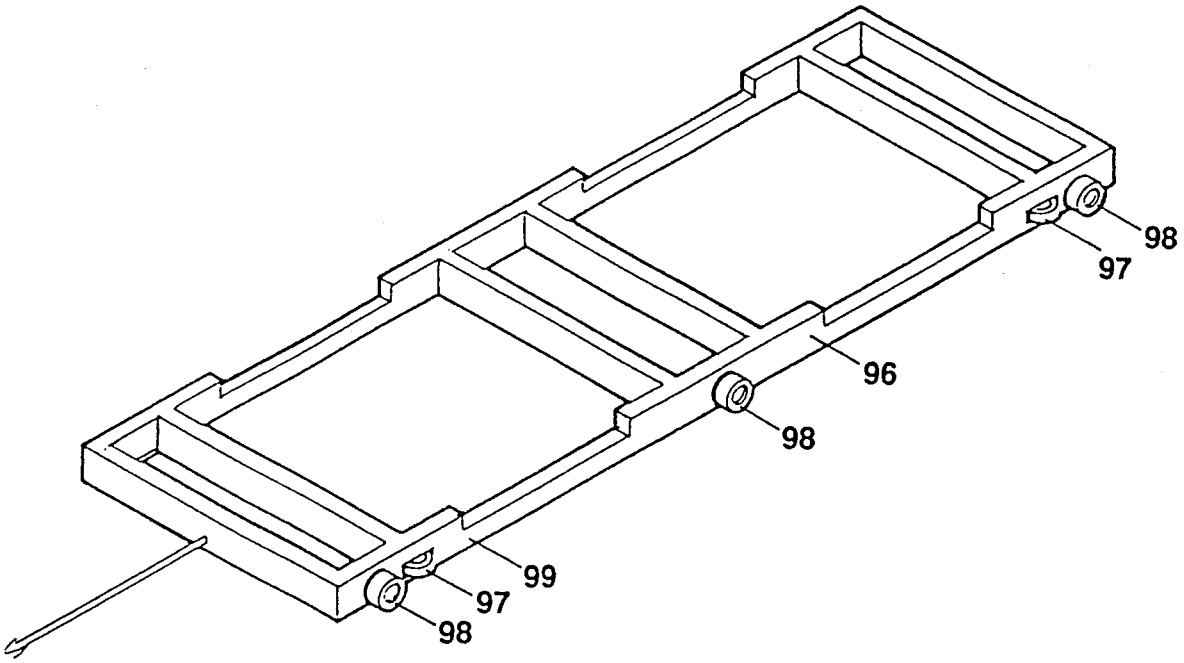
FIG. 14 is an isometric view of the chassis of a pallet locating module of the type illustrated in FIG. 13.

The smaller pallets 90 may also be conveyed to and from the parking bay to adjacent storage locations on pallet locating modules 95, see FIGS. 13 and 14, designed specifically to support a pair of pallets 90 a predetermined distance apart. Each pallet locating module 95 includes a substantially rectangularly shaped chassis 96 and a plurality of rollers 97 and 98 mounted in alternating horizontal and vertical attitudes respectively along the longitudinal side walls 99 of the chassis 96. The rollers 97 and 98 are adapted to travel within the channel shaped recesses of the longitudinal bay frame members 23 of a storage bay 20 or 21, or opposing longitudinal structural frame members 47. The pallet locating module 95 also includes two pallet positioning panels 100 having two rectangularly shaped recesses 101 formed therein in which respective pallets 90 may be positioned. The pallet positioning panels 100 maintain the pallets 90 in a spaced relationship and provide a flat platform upon which a vehicle may be driven until the wheels of the vehicle are positioned in the recesses 91 of the respective pallets.

Because the length separating the front and rear axles of various makes of vehicle may vary, it is desirable that the positioning of the pallets 90 on the pallet locating module 95 also be variable so as to accommodate as many makes of vehicle as is possible. Accordingly, the pallet positioning panels 100 are capable of movement along the chassis 96 in the direction of arrows 102. Furthermore, beneath each of the pallet positioning panels 100 there is provided lifting means for raising the flanges 94 of the pallets 90 above the flanges 72 of opposing longitudinal bay frame members 23 or the flanges 73 of opposing longitudinal structural frame members 47 so as to enable the pallet dolly to enter or leave the storage locations for the purpose of depositing or retrieving pallets.

FIG. 11 illustrates yet another pallet 110 for the support of a vehicle including a substantially rectangularly shaped panel 111 having formed therein wheel locating recesses 112 and a longitudinally extending drip tray 113. The longitudinal sides 114 of each pallet 110 each include a plurality of outwardly directed flanges 115 which, in use, overlie and abut the flanges 72 of opposing longitudinal bay frame members 23 or the flanges 73 of opposing longitudinal structural frame members 47.

In use, a driver approaches the entrance to the automated car park 10 in the same manner as he or she would approach an entrance of a conventional car park. The automated car park may include a boom gate which in addition to controlling entry into the car park, may further indicate to the driver which gate or parking bay he or she should proceed to. The boom gate may include recorded voice instructions and other visual aids. Where dual pallets 90 are to be used to support a vehicle as opposed to the use of pallets 55 or 110, some type of sensing device may be incorporated at or near the point of entry to the car park so as to determine the spacing between the front and rear axles of the vehicle and accordingly preset the distance separating the two pallets 90 on the pallet locating module 95 and the pallet dolly 75 intended to be used to support and transport the vehicle within the car park.

Having proceeded past the entrance to the car park, the driver shall park the car in the centre of the nominated parking bay located on the ground level 43 atop a pallet 55. Preferably the pallet 55 is delineated by appropriate markings recorded thereon indicating the preferred "parked" position of the car on the pallet. In order to aid the driver in parking the car on the pallet 55, there may be provided sensors which may indicate the correct or incorrect positioning of the car atop the pallet 55. In the event that pallets 90 or 110 are used to support the vehicle, the driver upon entering the car park shall position the wheels of the vehicle in the respective wheel locating recesses 91 or 112 of the pallets 90 or 110 respectively.

Once correctly parked, vehicle securing means, not shown, may be used to engage the wheels of the car thereby preventing further movement of the car relative to the pallet 55, 110 or pallets 90 respectively.

At this stage, the driver and any passengers may get out of the car, unload any luggage stored therein and proceed to an exit. There may also be provided a ticket dispensing machine for the issue of parking tickets and the control of the pallet locating module 95 and pallet trucks 57.

Where dual pallets 90 are used to support the vehicle, a pallet locating module 95 is used to move the pallets 90 only between the parking bay and an inner storage bay adjacent to the central aisle on the parking level.

Once the driver and passengers have left the parking bay, the pallet locating panels 100 are used to raise the pallets 90 clear of a pair of opposing supporting flanges, such as for example flanges 73 of opposing structural members 47. Once the pallets 90 are supported by the supporting flanges, the pallet locating modules 100 are retracted and the pallet dolly 95 is returned to the parking bay for subsequent use. The vehicle and the pallets 90 may be collected from the inner storage bay by a pallet truck 57.

Upon instructions relayed by the driver to the ticket dispensing machine or by a parking attendant to appropriate actuation means, the pallet truck 57 upon which the car and pallet 55 or 110 or pallets 90 rest will be transported to a predetermined storage bay 21 or a storage location 46 contained within the car park, the location of the storage bay 21 or the storage location 46 being dependent upon the time when the driver of the car will return for his or her car. For example, a car which is to be parked for a long time may be housed in a more remote location within the car park whilst a car to be parked for only a short period of time, such as an hour, may be housed on a lower level or storage bay closer to the entrance of the car park thereby facilitating the quickest possible recovery of the car upon the drivers return. The retrieval of the car from its stored location within the car park may also be controlled by instructions relayed by either the driver or a parking attendant to either the ticket dispensing machine or appropriate actuation means. In order to prevent the car being stolen from the car park, retrieval of the car may only be achieved perhaps by the insertion in whichever actuation means is used of a parking ticket and or personal identification number known only to the driver.

The pallet truck 57 upon which the car is supported travels in a horizontal attitude upon tracks 32 or selected transverse structural members 48 which run along the edges of and so define the aisles 44 of each level 42 or 43 of the car park. The pallet truck 57 is transported between levels by lifts 45. Movement of the pallet truck 57 within the car park is controlled by the aforementioned actuation means which preferably includes a plurality of electrical sensors 83 mounted on the pallet truck thereby aiding in the determination of the truck's position relative to the storage bays 21 contained within the car park. Once the pallet truck 57 has arrived opposite the selected storage bay 21, the pallet dolly 56 enters the storage bay travelling along the longitudinal frame members 23. Having reached the position within the storage bay where the car is to be stored, the jacks 70 are used to lower the pallet 55 onto the frame members 23 such that flanges 72 and 74 abut. The pallet dolly 56 is then retracted to its previous position atop the pallet truck 57.

A similar procedure is used to shift vehicles from one storage bay to another and to retrieve a vehicle at the driver's request. To reverse the orientation of the vehicle once retrieved so as to enable the driver to drive the vehicle out of the car park, there is preferably provided pallet trucks 57A equipped with a turntable 84 which can rotate a vehicle mounted on top of a pallet or pallets so that the vehicle is facing the opposite direction to that which it was parked. This is particularly useful in car park configurations which can accommodate parking bays on one side of the building only. The use of the turntable means that drivers do not have to reverse out of a parking bay.

FIG. 5 illustrates a rack like structure 86 contained within a number of storage bays 21 or storage locations 46 on a plurality of levels of the car park for the storage of pallets 55, 90 or 110 as illustrated. Pallets 55, 90 and 110 may be retrieved from the rack like structure 86 following the same procedure used to retrieve vehicles from the storage bays 21 or the storage locations 46.

The pallets may be pressed from sheets of steel or a metal alloy. However, it is possible that the pallets, as an alternative, may be made of precast reinforced concrete, a plastics material, fiberglass, plywood, laminated wood or a combination thereof and wherein the pallets include a core filled with a variety of preferably light weight materials such as foam or a cementitious mixture of wood chips and an adhesive.

It will be appreciated that the car park as described requires less area per parking space, signage, lighting and ventilation than conventional car parks. Furthermore, being demountable, the car park may be erected on a temporary site and later relocated. Furthermore, due to the fact that power is supplied only to the pallet trucks and the fact that the storage locations do not include power cables and the like, the storage apparatus may be assembled quickly. It will also be appreciated that cars parked in the car park described are protected from any accidental or malicious damage which otherwise be caused by other drivers or pedestrians in the car park.

It will of course be realised that the above has been given only by way of illustrative example of the present invention and that all such modifications and variations thereto as would be apparent to persons skilled in the art are deemed to fall within the broad scope and ambit of this invention as is herein defined in the appended claims.

I claim:

1. Storage apparatus comprising:

a) a plurality of storage areas, b) a substantially horizontal path traversing past the storage areas, c) a carriage means adapted to move along the path, d) transportation means carried by the carriage means and adapted to be moved from a suitably aligned carriage means into and out of a storage area, e) an unwheeled pallet adapted to carry an article to be stored and adapted to be supported on the transportation means, f) lifting means on the transportation means capable of raising and lowering a pallet on the transportation means so that the pallet may be deposited in a storage area and the transportation means removed from the storage area, and g) the storage areas are each defined by a pair of members each having a lower horizontal flange and an upper horizontal flange which extend inwardly into the storage area, the transportation means being adapted to ride on the lower flanges and the lifting means being adapted to lower the pallet onto the upper flanges.

2. The storage apparatus according to claim 1 wherein the pair of members are storage area beams and the substantially horizontal path is defined by a pair of opposed path beams which are arranged substantially perpendicular to the storage area beams, the opposed path beams having at least one flange extending inwardly into the horizontal path.

3. The storage apparatus according to claim 1 wherein the carriage means includes a pair of tracks and the transportation means includes wheels for engaging in and riding in said tracks, said tracks being arranged in registry with the lower flanges of the pair of member when the carriage means is aligned with a storage area so that the transportation means is movable along the pair of tracks and on to the lower flanges of the storage area.

4. The storage apparatus according to claim 2 wherein the plurality of storage areas each comprise a substantially box-like framework including opposed rectangularly shaped end bay frame members, and the storage area beams extending between the end bay frame members.

5. The storage apparatus according to claim 4, wherein said box-like framework includes connecting means for interconnecting a plurality of the storage areas side by side and one atop another so as to create an array of storage locations.

6. The storage apparatus according to claim 1 wherein the carriage means and transportation means are provided with vertically arranged and horizontally arranged wheels for guiding and allowing movement of the carriage means along the path, and for allowing movement of the transportation means relative to the carriage means and on the lower flanges of the storage areas.

7. The storage apparatus according to claim 1 wherein the transportation means comprises a pallet locating module for receiving a pair of small pallets and for locating the small pallets a predetermined distance apart, the pallet locating module being movable into and out of a storage area to deposit the small pallets onto the upper flanges of the storage area.

8. Storage apparatus comprising:

a) a plurality of storage areas, b) a substantially horizontal path traversing past the storage areas, c) a carriage means adapted to move along the path, d) transportation means carried by the carriage means and adapted to be moved from a suitably aligned carriage means into and out of a storage area, e) an unwheeled pallet adapted to carry an article to be stored and adapted to be supported on the transportation means, f) lifting means on the transportation means capable of raising and lowering a pallet on the transportation means so that the pallet may be deposited in a storage area and the transportation means removed from the storage area, and g) the transportation means is mechanically independent of, and provided with driving means independent of, the carriage means.

9. The storage apparatus according to claim 8 wherein the carriage means includes a pair of tracks and the transportation means includes wheels which ride in the tracks to enable the transportation means to move relative to the carriage means into a storage area, a retractable power cable extending between the transportation means and the carriage means for providing power to the carriage means.

10. Storage apparatus comprising:

a) a plurality of storage spaces arranged such that a number of storage spaces are disposed on each of a number of separate levels spaced vertically apart, b) a substantially horizontal path traversing past the storage spaces on each level, c) at least two carriage means each adapted to move along each of the horizontal paths, d) transportation means carried by each of the carriage means and each being adapted to be moved from a suitable aligned carriage means into and out of a storage area, e) an unwheeled pallet adapted to carry an article to be stored and adapted to be supported on the transportation means, f) lifting means on the transportation means capable of raising and lowering a pallet on a transportation means so that the pallet may be deposited in a storage area and the transportation means removed from the storage area, g) at least two elevating means adapted to move the carriage means vertically between the respective paths, and h) the two elevating means are disposed at either end of the respective paths such that if one carriage means is disabled on a path, other carriage means can access the storage areas on either side of the disabled carriage means.

* * * * *